US007319473B2

(12) United States Patent
Wiens

(10) Patent No.: US 7,319,473 B2
(45) Date of Patent: Jan. 15, 2008

(54) THERMAL RECORDING SYSTEM AND METHOD

(75) Inventor: Curt A. Wiens, Oakdale, MN (US)

(73) Assignee: Carestream Health, Inc., Rochester, NY (US)

( * ) Notice: Subject to any disclaimer, the term of this patent is extended or adjusted under 35 U.S.C. 154(b) by 256 days.

(21) Appl. No.: 11/315,106

(22) Filed: Dec. 22, 2005

(65) Prior Publication Data

US 2007/0146466 A1 Jun. 28, 2007

(51) Int. Cl.
*B41J 2/355* (2006.01)

(52) U.S. Cl. ..... 347/183

(58) Field of Classification Search ..... 347/184, 347/183, 182, 181, 180, 188, 195, 171
See application file for complete search history.

(56) References Cited

U.S. PATENT DOCUMENTS 4,802,105 A 1/1989 Suzuki
5,533,816 A 7/1996 Ikeda et al.
5,573,995 A 11/1996 Janssens et al.
5,786,837 A 7/1998 Kaerts et al.
5,833,376 A 11/1998 Pattyn
5,896,160 A * 4/1999 Katsuma et al. ..... 347/195
5,994,052 A 11/1999 Weaver et al.
6,109,799 A 8/2000 Pattyn
6,195,110 B1 * 2/2001 Kokubo et al. ..... 347/182
6,597,385 B2 7/2003 Verdyck
6,774,084 B2 8/2004 Loccufier et al.
2001/0002138 A1 * 5/2001 Inui ..... 347/183

FOREIGN PATENT DOCUMENTS

EP 654 355 B1 2/1998

* cited by examiner

*Primary Examiner*—K. Feggins

(57) ABSTRACT

A recording apparatus includes a plurality of thermal elements, a strobe generator, and a data sequencer. The strobe generator provides a strobe signal comprising a sequence of N pulses, each pulse having a same period, the sequence including a first group of pulses having an active state for a first duration a second group of pulses having an active state for a second duration, wherein each pulse of the second group is positioned next to a pulse of the first group such their active states combine form a continuous active state. The data sequencer provides an N-bit data sequence representative of a gradation level to each thermal element, each bit corresponding to one of the N pulses, wherein the N bits have active states such that whenever the corresponding gradation level is within a predetermined range and whenever a bit corresponding to a pulse of the second group has an active state the bit corresponding to adjacent pulse of the first group has an active state, wherein each thermal element generates heat based on the strobe signal and the corresponding N-bit sequence.

24 Claims, 6 Drawing Sheets

THERMAL RECORDING SYSTEM AND METHOD

FIELD OF THE INVENTION

The present invention relates generally to an apparatus and method for thermally recording an image on a recording media, and more specifically to an apparatus and method for providing gray levels in a thermally recorded image.

BACKGROUND OF THE INVENTION

Thermal imaging, or thermography, is a recording process wherein images are generated by the use of image-wise modulated thermal energy. There are two commonly known methods for thermal imaging. The first is generally referred to as thermal dye transfer printing and the second as direct thermal printing. Thermal dye transfer printing generally involves heating a donor element to transfer dye from the donor element to a print media to produce a desired image. Direct thermal printing involves directly heating a thermosensitive imaging media to cause a chemical reaction that produces a desired image on the imaging media.

In direct thermal printing, application of heat to the imaging media is generally accomplished through use of a thermal recording head or printhead. Thermal printheads typically comprise a number of microscopic heating elements, generally resistors, spaced in a line-wise fashion across the printhead. The thermal printhead prints one line of pixels of an image at a time, with each resistor producing one pixel of the line of pixels on the thermosensitive media. A media transport system (e.g. a dc stepper motor) incrementally moves the imaging media past the thermal printhead as the individual lines of pixels are printed such that the desired image is constructed from a large number of individually printed lines of pixels.

The printed density produced by each heating element is a function of the amount of thermal energy transferred by the heating element to the imaging media, with a greater amount of thermal energy producing a higher printed density. Conventionally, the heating elements are binary controllable devices, meaning that only on/off control is employed to control the amount of thermal energy generated and transferred to the print media by the heating element.

When printing a desired image, an image data value for each pixel is received, with each data value being representative of a desired printing density. The image data value for each pixel is converted into a corresponding series of 1-bit values and a time-multiplexing scheme is employed to consecutively feed the 1-bit values of each series to the corresponding heating element. This process is commonly referred to as "time slicing." To print each pixel, each 1-bit value of each series is transmitted to the corresponding heating element for a same duration, commonly referred to as the time step, or time slice, of the slicing process.

A strobe signal is employed to enable each heating element to become energized during each time step so as to generate thermal energy based on the state of the corresponding 1-bit value of the series. To provide different printing densities, or "gradation levels", the sequences of 1-bit values are arranged so as to energize the heating element for a time necessary to produce a desired printing density. The arrangement of each sequence can be based on several factors, such as a temperature of the corresponding thermal element, for example, such that different sequences of 1-bit values may be provided to different thermal elements to produce a same printing density.

The resolution of a thermal printing apparatus depends on the number of gradation levels that can be generated by the printhead. The higher the number of gradation levels, the higher the resolution and the higher the quality of the printed image. In order to increase the resolution, several approaches have been employed to increase the number of gradation levels capable of being produced by the printhead.

According to one type of conventional thermal printing apparatus, a sequence of N 1-bit data values must be provided to each thermal element to provide N gradation levels. One approach employed to increase the number of gradation levels is to simply increase the number of 1-bit data values provided to each thermal element. However, increasing the number of gray levels in this fashion increases the time required to print each line of pixels. To maintain print times at acceptable levels requires an increase in the clock frequency and/or an increase in the degree of parallelism of the printhead (e.g. more shift registers). However, increasing the degree of parallelism increases the complexity and cost of the printhead and the clock frequency is limited by the printhead components (e.g. shift-register operating frequencies).

Other approaches to increase the number of gradation levels involve varying the pulse width of the strobe signal (i.e. the enable time of the thermal element). Such approaches generally increase the number of available gradation levels without increasing the required clock frequency. However, with some approaches, varying the strobe pulse width in this manner results in the thermal elements being heated in a non-continuous fashion. Thus, even though the thermal elements may be energized for an amount of time corresponding to a given gradation level, heat dissipation of the thermal elements in the time interval during which they are not energized may result in a lower than desired print density.

In another approach, heating of the thermal elements is substantially continuous when varying the strobe pulse width, but is centered within the corresponding pixel area on the imaging media as it is moved past the thermal element during the printing of the pixel data. While such an approach may be desirable for halftone image recording, it provides poor uniformity of the print density across the pixel area and is not desirable for continuous tone imaging, such as employed for medical imaging purposes, for example.

It is evident that there is a need for increasing the gradation levels available without increasing required clock times, particularly for thermal imaging systems configured to perform continuous tone thermal recording.

SUMMARY OF THE INVENTION

In one embodiment, the present invention provides a recording apparatus including a plurality of thermal elements, a strobe generator, and a data sequencer. The strobe generator is configured to provide a strobe signal comprising a sequence of N pulses, the sequence including a first group of pulses having an active state for a first duration and a second group of pulses having an active state for a second duration, wherein each pulse of the second group is positioned next to a pulse of the first group such their active states combine to form a substantially continuous active state. The data sequencer is configured to provide an N-bit data sequence representative of a gradation level to each thermal element, each bit corresponding to one of the N pulses, wherein the N bits have active states such that whenever the corresponding gradation level is within a predetermined range and whenever a bit corresponding to a pulse of the second group has an active state the bit corresponding to adjacent pulse of the first group has an active state, wherein each thermal element (42) generates heat based on strobe signal (50) and the corresponding N-bit sequence (60).

In one embodiment, the pulses of the second group of pulses are positioned at substantially equal intervals throughout the sequence of N pulses. In one embodiment, the first duration is substantially equal to a period of one of the N pulses. In one embodiment, the second duration is equal to fraction of the first duration.

In one embodiment, each of the thermal elements is configured to become energized and produce thermal energy when the strobe pulse and the corresponding data bit each have an active state. In one embodiment, the first group of pulses comprises a total of S pulses and the second group of pulses comprises a total of P pulses, where the sum of S and P is equal to N, and wherein the recording apparatus provides up to G gradation levels, where G is equal to the product of (S+1) multiplied by (P+1).

By providing a strobe signal having a first group of S pulses and a second group of P pulses in this fashion to control the energization time of the thermal elements, a recording apparatus according to the present invention increases the number of gradation or gray scales available to thermally print an image without substantially increasing print times and without requiring an increase in operating frequency and complexity of hardware requirements of the recording apparatus. Furthermore, by spacing the strobe pulses of the second group at substantially equal intervals throughout the N-bit data sequence, a print density of a pixel produced by each thermal element on an associated thermosensitive media is substantially uniform, thereby making a recording apparatus according to the present invention well-suited for continuous tone printing applications, such as medical imaging applications, for example.

BRIEF DESCRIPTION OF THE DRAWINGS

The foregoing and other objects, features, and advantages of the invention will be apparent from the following more particular description of the embodiments of the invention, as illustrated in the accompanying drawings. The elements of the drawings are not necessarily to scale relative to each other.

DETAILED DESCRIPTION OF THE INVENTION

Figure 1:
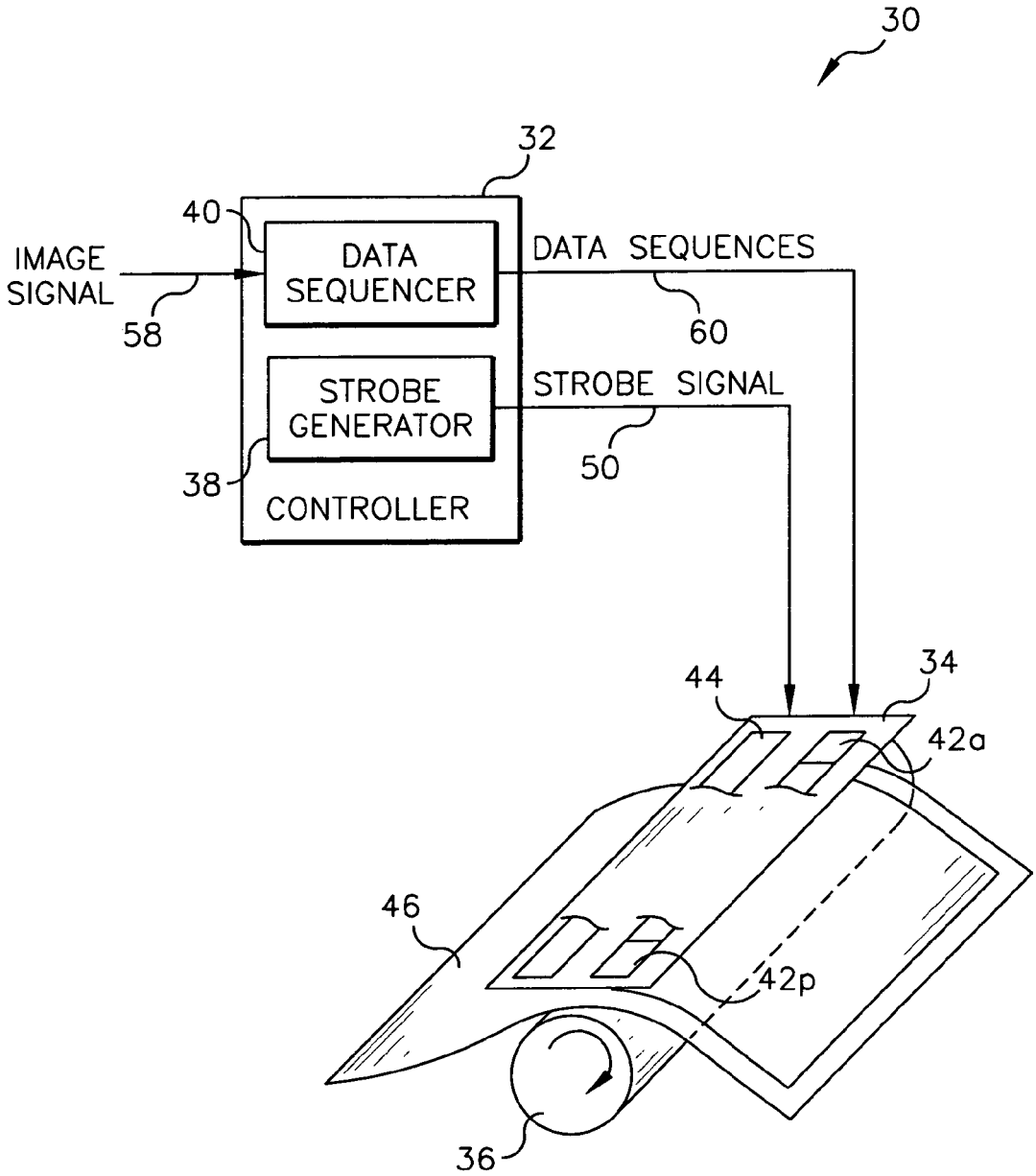
FIG. 1 is a block diagram illustrating generally one exemplary embodiment of a direct thermal printer according to the present invention.

The following is a detailed description of the preferred embodiments of the invention, reference being made to the drawings in which the same reference numerals identify the same elements of structure in each of the several figures.

FIG. 1 is a block diagram illustrating generally one embodiment of a direct thermal printer 30 employing strobe pulsing and data sequencing techniques in accordance with the present invention for increasing a number of gray levels available for printing an image on an imaging media without substantially increasing operating frequency and circuitry requirements. Thermal printer 30 includes a controller 32, a thermal printhead 34, and a rotatable drum 36, with controller 32 further including a strobe generator 38 and a data sequencer 40. Thermal printhead includes a plurality of individually energizeable thermal elements 42 (illustrated as thermal elements 42*a* to 42*p*), such as resistors, for example, which are positioned along with associated drive circuitry 44 to form a linear array across thermal printhead 34.

A recording media 46, which may be of web or sheet form, is secured to rotatable drum 36 which is driven by a driving means (not shown), such as a stepper motor, for example, so that recording media 46 is advanced past thermal elements 42. In one embodiment, recording media 46 comprises a thermosensitive media having a base material, such as polyester, coated with a thermosensitive layer. As thermosensitive media 46 is moved past thermal printhead 34, thermal elements 42 heat proximate areas of thermosensitive media 46 and produce a desired density change in the thermosensitive layer that is proportional to the amount of thermal energy provided by the corresponding thermal element 42. Each of the proximate areas heated by thermal elements 42 comprises a pixel of a printed image, with each thermal element 42 providing one pixel of a line of pixels provided by thermal printhead 34. Thermal printhead 34 prints one line of pixels or one scan-line at a time as thermosensitive media 46 is moved past thermal printhead 34 by rotatable drum 36, such that a printed image is constructed from a plurality of successive scan lines.

Strobe generator 38 provides a strobe signal 50 in accordance with the present invention to thermal printhead 34. In one embodiment, strobe signal 50 comprises a sequence of N pulses each having a same period, the sequence of N pulses including a first group of pulses having an active state (e.g. a binary value of "1") for a first portion of the period and a second group of pulses having an active state (e.g. a binary value of "1") for a second portion of the period, wherein the second portion is less than first portion. In one embodiment, the first group comprises a total of S pulses and the second group comprises a total of P pulses, wherein the sum of S and P equals N.

Within the sequence of N strobe pulses, each of the P pulses of the second group is positioned immediately adjacent to at least one of the S pulses of the first group. In one embodiment, the active state of each of the P pulses of the second group and the active state immediately adjacent pulse of the first group are positioned within their corresponding strobe periods such that active states of each of the P pulses and the active state immediately adjacent pulse of the first group form a substantially continuous active state (see FIG. 3 below).

In one embodiment, the duration of the active state of each of the S strobe pulses of the first group is substantially equal to the strobe pulse period. In one embodiment, the duration of the active state of each of the P strobe pulses of the second group is equal to a fraction of the duration of the active state of the S strobe pulses of the first group. In one embodiment, the second portion is substantially equal to one-eighth of a strobe pulse period. In one embodiment, the second portion is substantially equal to one-sixteenth of a strobe pulse period.

In one embodiment, the active state of the each of the P pulses of the second group has a duration such that the sum of P+1 multiplied by the duration of the active state of one of P pulses is substantially equal to the duration of the active state of one of the S strobe pulses of the first group. As an illustrative example (and as will be described in greater detail below by FIG. 3), assume that each of the N strobe pulses has a period of 8 microseconds (μs), that each of the S strobe pulses of the first group has an active state substantially equal to a strobe pulse period (i.e. 8 μs), and that the active duration of each of the P pulses of the second group is approximately equal to one-eighth the duration of the active state of one of the S pulse of the first group (i.e. 1 μs). Based on the above relationship, the sum of P+1 pulses multiplied by 1 μs is equal 8 μs (i.e. (P+1)*1 μs=8 μs), meaning that there are a total of seven pulses (P=7) in the second group of pulses of the illustrative example.

In one embodiment, the P strobe pulses of the second group are spaced at substantially equal intervals throughout the sequence of N pulses. For example, using the illustrative example described above (and as will be described in greater detail below by FIG. 3), where P equals 7 and assuming that there are a total of 518 strobe pulses in the sequence (i.e. N=518), every seventy-fourth pulse of the sequence of 518 pulses comprises one of the P pulses of the second group of pulses beginning with the first pulse of the sequence. The remaining 511 pulses comprise pulses of the first group (i.e. S=511).

In operation, controller 32 receives an image signal 58 comprising an M-bit image data value for each pixel of the image to be printed by thermal printhead 34, with the M-bit image data value being representative of the desired gradation level (i.e. printing density) of the pixel. In accordance with the present invention, and as will be described in greater detail by FIG. 3 below, thermal printer 30 is able to provide up to G gradation levels, where G is equal to the product of (S+1) multiplied by (P+1), and wherein the gradation levels range from 0 to G-1. However, in order to utilize the full range of G gradation levels, the number of bits M of the image data value must be such that $2^M$ is at least equal to G. For example, continuing with the illustrative example above, where S=511 and P=7, thermal printer 30 is able to provide up to 4,096 gradation levels (i.e. 8×512=4,096), meaning that M must have a value of at least twelve (i.e. $2^{12}$=4,096).

Data sequencer 40 generates a binary sequence of N 1-bit values from each of the M-bit image data values, with each N-bit binary sequence being representative of the associated gradation level. Data sequencer 40 provides each N-bit data sequence to the corresponding thermal element as indicated at 60, wherein each bit of each N-bit binary sequence corresponds to a different one of the N strobe pulses of strobe signal 50. In one embodiment, whenever the associated gradation level is within a range of gradation levels the active states of the N-bit data values are such that whenever a data bit corresponding to one of P strobe pulses of the second group has an active state (i.e. a logic value of "1"), the data bit corresponding to immediately adjacent pulse of the first group also has an active state. In one embodiment, as will be described in greater detail below by FIG. 5, the range of gradation levels is approximately from a minimum detectable printing density to a maximum desired printing density.

Drive circuit 44 of thermal printhead 34 energizes each of the thermal elements 42 based on strobe signal 50 and corresponding N-bit binary sequence 60 to provide an amount of thermal energy necessary to produce the associated gradation level at the corresponding pixel location on thermosensitive imaging media 46. In general, the longer a thermal element is energized, the higher the gradation level that is produced at the corresponding pixel location on thermal sensitive media 46. In one embodiment, drive circuit 44 energizes a thermal element 42 when a pulse of strobe signal 50 has an active state (e.g. a logic value of "1") and the corresponding data bit of the N-bit binary sequence 60 has the active state (e.g. a binary value of "1"). This process is repeated for each pixel of each line of pixels to thermally print a desired image on thermosensitive media 46.

By providing a strobe signal having a first group of S pulses and a second group of P pulses in this fashion to vary the energization time of thermal elements 42, thermal printer 30 according to the present invention provides up to (S+1)*(P+1) gradation levels or gray scales using a binary sequence of N data bits (i.e. N=S+P) for each thermal element 42. For example, in the above example, thermal printer 30 provides up to 4,096 gradation levels using binary data sequences comprising only 518 1-bit values to represent the desired gradation level. As such, thermal printer 30 according to the present invention increases the number of gradation or gray scales available to thermally print an image without substantially increasing print times and without requiring an increase in operating frequency and complexity of hardware requirements of thermal printhead 34. Furthermore, by spacing the P strobe pulses of the second group at substantially equal intervals throughout the binary sequence of N 1-bit values, the print density is substantially uniform across the corresponding pixel area on thermosensitive media 46, thereby making thermal printer 30 well-suited for continuous tone printing applications, such as medical imaging applications, for example.

Figure 2:
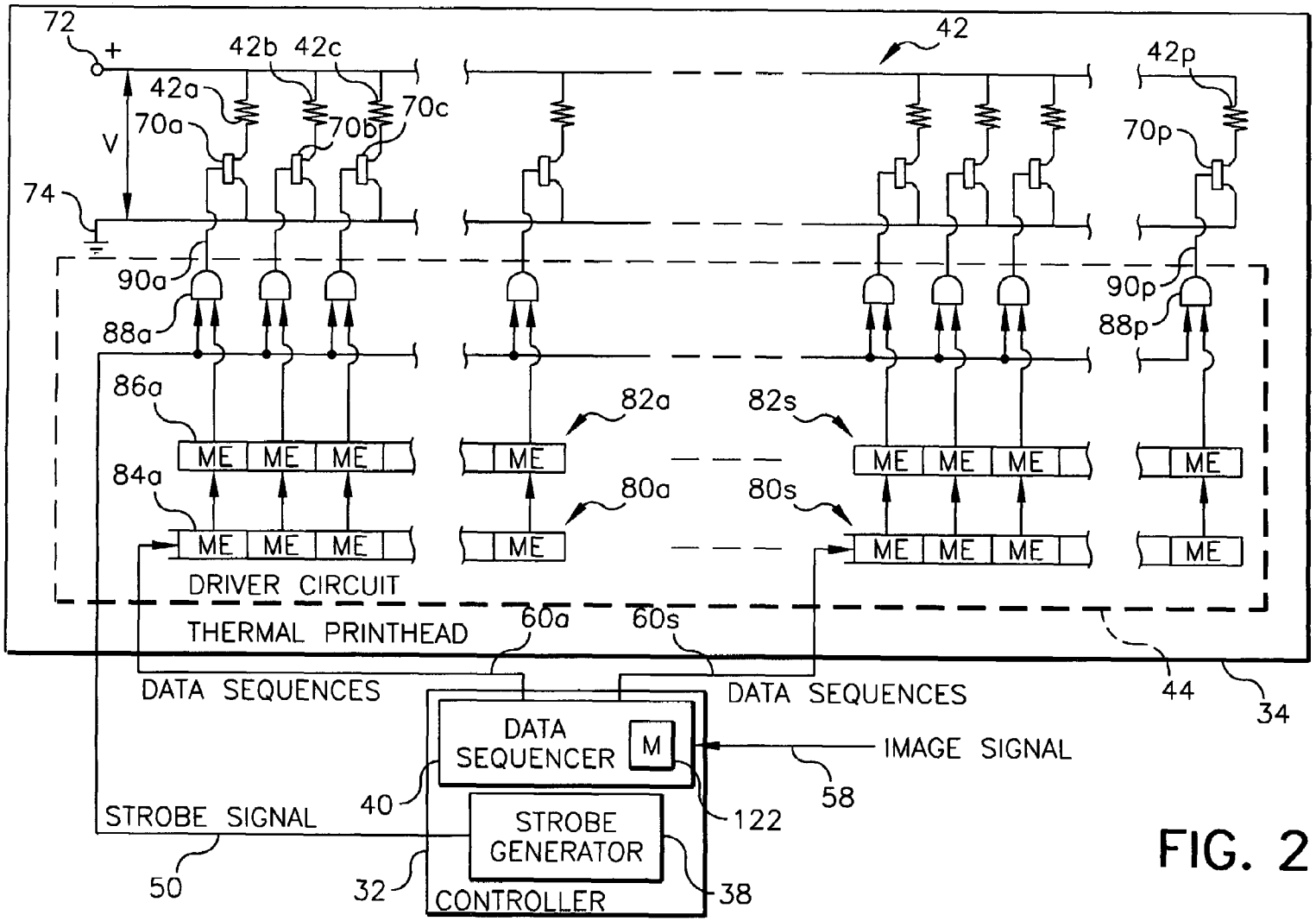
FIG. 2 is a block and schematic diagram illustrating portions of a thermal printer according to one embodiment of the present invention.

FIG. 2 is block and schematic diagram illustrating portions of one embodiment of thermal printer 30 according to the present invention, wherein thermal printhead 34 employs a conventional electronic implementation scheme. In one embodiment, as illustrated, each of the individually energizeable thermal elements 42*a* to 42*p* of thermal printhead 34 consists of a resistor, with resistors 42*a* to 42*p* arranged to form a linear array. A plurality of drivers or switches 70 are indicated at 70*a* to 70*p*. In one embodiment, as illustrated, each of the switches 70*a* to 70*p* consists of a transistor. Each of the switches 70*a* to 70*p* is coupled to and individually controller to energize a corresponding one of the resistors 42*a*-42*p* by coupling it to a reference 74 (e.g. ground reference) so as to form a current path between a supply voltage 72 and reference 74.

Drive circuitry 44 comprises a plurality of serial-in, parallel-out shift registers 80, indicated at 80*a* to 80*s*, and a corresponding plurality of parallel-in, parallel-out latch registers 82, indicated at 82*a* to 82*s*. Each of the registers 80 and 82 comprises a plurality of memory elements 84 (ME), such as indicated by example memory element 84*a* of shift register 80*a* and example memory element 86*a* of latch register 82*a*. Each of the memory elements 84 and 86 corresponds to one of the thermal elements 42. For example, as illustrated by FIG. 2, memory elements 84*a* and 86*a* correspond to thermal element 42*a*. In one example embodiment, thermal printhead 34 comprises 4,480 individually energizeable thermal elements 42 which are subdivided into 35 groups, each group comprising 128 individually energizeable thermal elements 42. Accordingly, one pair of shift and latch registers 80 and 82, each respectively including 128 memory elements 84 and 86, corresponds to each of the 35 groups of 128 thermal elements 42.

Drive circuitry 44 further includes a plurality of gates 88, indicated as gates 88*a* to 88*p*. In one embodiment, as illustrated, each gate 88*a* to 88*p* consists of an AND-gate. Each memory element of each shift register 80 is coupled to a corresponding memory element of a corresponding latch register 82 which, in turn, is coupled a first input of a corresponding AND-gate 88. A second input of each AND-gate 88 receives strobe signal 50 from strobe generator 38. Each AND-gate 88 provides an energization signal 90 via an output to the control gate of a corresponding switch 70 (i.e. transistor), as indicated at 90*a* to 90*p*.

In operation (as described above by FIG. 1), controller 32 receives an image signal 58 comprising an M-bit image data value for each pixel of a desired image to be printed via thermal printhead 34. In response, data sequencer 40 generates a binary sequence of N 1-bit values for each M-bit image data value, wherein each N-bit binary sequence is representative of the desired gradation level of the corresponding pixel. For each line of pixels to be printed, data sequencer 40 generates a serial data stream of 1-bit data values for each pair of shift and latch registers 80, 82 by sequencing the N-bit binary sequences of each of the corresponding thermal elements 42. Data sequencer provides the serial data streams to each of the corresponding shift register 80, as illustrated at 60*a* through 60*s*.

To print a line of pixels, data sequencer 40 shifts a portion of the serial data stream into the corresponding shift register 80 such that one bit of each of the N-bit binary sequences is shifted into the appropriate memory element 84. The 1-bit values in each memory element 84 of shift registers 80 are then parallel-shifted to the corresponding memory element 86 of latch registers 82. The 1-bit value from each memory element 86 and the corresponding strobe pulse of strobe signal 50 are provided to the inputs of the corresponding AND-gate 88. Based on strobe signal 50 and the 1-bit values from the corresponding memory element of corresponding latch register 82, each AND-gate 88 provides an energization signal 90, indicated as 90*a* to 90*p*, to the control gate of the corresponding switch 70 to create electrical pulses through resistors 42 to produce an amount of thermal energy required to provide desired density changes in thermosensitive media 46 (see FIG. 1).

In one embodiment, when the 1-bit value from the corresponding memory element 86 and the strobe pulse each have an active state (e.g. a logic value of "1"), AND-gate 88 provides energization signal 90 with a value that causes the corresponding switch 70 to close and couple the corresponding resistor 42 between supply voltage 72 and ground 74, thereby energizing resistor 42 and causing thermal energy to be transferred to thermosensitive media 46. Conversely, if the strobe pulse and/or the 1-bit value from corresponding memory element 86 have an inactive state (e.g. a logic value of "0"), AND-gate 88 provides energization signal 90 with a value that causes AND-gate 88 to remain open so that resistor 42 is not energized and no thermal energy is transferred to thermosensitive media 46.

While AND-gates 88 and switches 70 are controlling the energization of resistors 42, data sequencer 40 shifts a next portion of the serial data stream into the corresponding shift register 80 such that the next bit of each of the N-bit binary sequences is shifted into the appropriate memory element 84. The above described process is then repeated. To print a line of pixels, this process is repeated until each of the N 1-bit values of each binary sequence has been serially-shifted into shift and latch registers 80, 82 and provided to AND-gates 88. For instance, continuing with the above described example wherein each binary sequence comprises 518 1-bit data values, the above described process is repeated 518 times to print one line of pixels of the image. This process, in-turn, is repeated for each line of pixels of the image to be printed.

Figure 3:
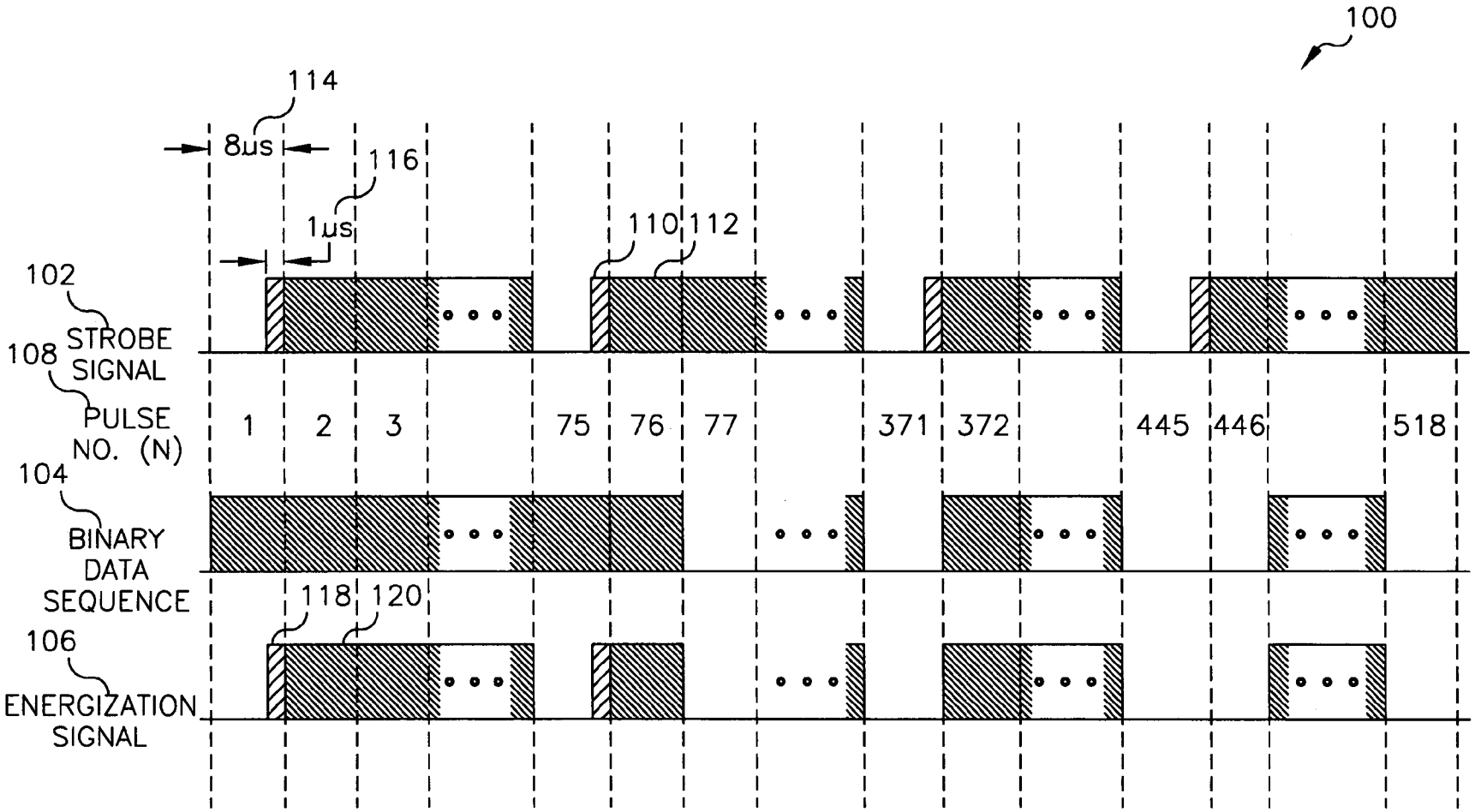
FIG. 3 is an example timing diagram illustrating the operation of the thermal printer of FIG. 2.

FIG. 3 is an example timing diagram 100 illustrating the operation of thermal printer 30 of FIG. 2 according to one embodiment of the present invention. Timing diagram 100 illustrates the operation of thermal printer 30 with respect to thermal element 42*a* of thermal printhead 34. Continuing with the example described above, timing diagram 100 illustrates the operation of thermal printer 30 wherein strobe signal 50 comprises a sequence of 518 pulses (i.e. N=518), wherein the first group of strobe pulses comprises 511 pulses (i.e. S=511), and wherein the second group of strobe pluses comprises 7 pulses (i.e. P=7). Accordingly, thermal printer 30 according to the illustrated example of FIG. 3 is able to provide up to 4,096 gradation levels.

Timing diagram 100 includes a waveform 102 illustrating an example strobe signal 50, a waveform 104 illustrating an example 518-bit binary sequence representative of a desired gradation level to be printed by thermal element 42*a*, and a waveform 106 representative of energization signal 90*a* provided to thermal element 42*a* based on the strobe signal and binary data sequence represented by waveforms 102 and 104. Pulse numbers indicating the position of each strobe pulse within the sequence of N pulses of strobe signal 50 are illustrated at 108.

With reference to waveform 102, the active state of each of the P strobe pulses is illustrated by hatched lines, such as indicated at 110, and the active states of each of the S strobe pulses illustrated by "shading," such as indicated at 112. In one embodiment, as illustrated by waveform 102, the P strobe pulses of the second group are spaced at equal intervals throughout the sequence of N pulses of strobe signal 50 such that every seventy-fourth pulse of the sequence, beginning with the first pulse of the sequence, comprises one of the P fractional strobe pulses of the second group (i.e. N=1, 75, . . . , 445).

As illustrated, the active state of each of the P strobe pulses is positioned within its corresponding strobe period such that the active state of each of the P strobe pulses forms a continuous active state with the active state of the immediately adjacent one of the S strobe pulses. In one embodiment, as illustrated by waveform 102, each strobe pulse has period of 8 μs, as indicated at 114, with each of the S pulses of the first group having an active state substantially equal to the strobe period (i.e. 8 μs), and each of the P strobe pulses of the second group having an active state with a duration of approximately 1 μs, as indicated at 116.

More generally, the duration of the active state of each of the P strobe pulses of the second group is substantially equal to one-eighth the duration of the active state of one of the S pulses of the first group. Accordingly, a sum of the durations of the active states of eight such pulses of the second group would equal the duration of the active state of one of the S pulses of the first group, which is why the second group of P pulses of strobe signal 50, as illustrated by waveform 102, comprises only seven pulses (i.e. P=7). As such, since the duration of the active states of eight such pulses is merely representative of the duration of one of the S pulses of the second group, the second group of P pluses comprises only seven pulses (i.e. P=7).

Although the first and second groups of strobe pulses of strobe signal 50 are described by the illustrative example of FIG. 3 as comprising 7 and 511 pulses, respectively, the first and second groups of strobe pulses may comprise any number of pulses. For example, in one embodiment, strobe signal 50 may comprise a total of 526 pulses (i.e. N=526) with the first group of pulse comprising 511 pulses (i.e. S=511) and the second group of pulses comprising 15 pulses (i.e. P=15). In such an instance, thermal printer 30 would be capable of providing up to 8,192 gradation levels (i.e. 512×16=8,192). Any number of other combinations are also available (e.g. S=255 and P=7 for a total of N=262 and up to 2,048 gradation levels).

Waveform 104 represents an example 518-bit binary sequence generated by data sequencer 40 from an M-bit data value corresponding to thermal element 42*a* received as part of image signal 58. In the illustrated example, in order to fully employ the 4,096 available gradation levels, the M-bit data value must comprise at least a 12-bit data value (i.e. $2^{12}$=4,096). Data sequencer 40 provides the 518-bit sequence such that the active states of the sequence of bit are configured to cause thermal element 42*a* to provide an amount of thermal energy required to produce a gradation level in thermosensitive media 46 substantially equal to the gradation level represented by the M-bit data value.

The active states of the data bits of the N-bit binary sequence are configured such that whenever a data bit of the binary sequence corresponding to one of the P fractional pulses of the second group of strobe pulses has an active state (e.g. a logic value of "1"), the next data bit of the sequence also has an active state. For example, as illustrated by waveform 104, where the data bits of the binary sequence corresponding to strobe pulses "1" and "75" (each of which comprises on of the P pulses of the second group) have an active state, the next data bit of the N-bit sequence also has an active state. When the data bit of the N-bit data sequence corresponding to a partial pulse P of the series has an inactive state (e.g. a logic value of "0" as illustrated), such as the data bits corresponding to strobe pulses "371" and "445," the next data bit of the N-bit data sequence may have a logic value of "1" or "0", as indicated by the data bits of the N-bit data sequence corresponding to strobe pulses "372" and "446."

In one embodiment, data sequencer 40 employs a look-up table residing in a memory 122 (see FIG. 2) to generate the N-bit data sequences, such as the 518-bit data sequence illustrated by waveform 104. In one embodiment, data sequencer 40 selects and provides a particular N-bit data sequence to each thermal element 42 from the look-up table based on the M-bit image data value and a variety of other parameters such as the location of the thermal element on the printhead, the temperature of the print, and the gradation level being generated by adjacent thermal elements, for example. The use of such look-up tables is known generally to those skilled in the art.

In operation, as described above by FIG. 2, data sequencer 40 sequentially provides the 518 strobe pulses of strobe signal 50, as illustrated by waveform 102, and the corresponding data bits of the 518-bit binary sequence, as illustrated by waveform 104, to the inputs of AND-gate 88*a* corresponding to thermal element 42*a*. In response, AND-gate 88*a* provides energization signal 90*a* comprising a series of energization pulses, as illustrated by waveform 106, to the gate of switch 70*a* to control the energization of thermal element 42*a*. As illustrated by waveform 106, whenever a the strobe pulse of waveform 102 and the corresponding data bit of waveform 104 have an active state (e.g. a logic value of "1"), the energization signal 90*a* provided by AND-gate 88*a* has an active state which causes thermal element 42*a* to become energized and transfer thermal energy to the corresponding pixel location on thermosensitive media 46.

In one embodiment, which is not illustrated, strobe signal 50 includes a third group of Q strobe pulses, wherein each of the Q strobe pulses of the third group has an inactive state for the corresponding strobe pulse period. Such "inactive" strobe pulses may be inserted at various positions through the sequence of N strobe pulses for various purposes, such as to cool thermal printhead 34 to prevent overheating of thermal elements 42, for example. In such an embodiment, the sum of the S pulses of the first group, the P pulses of the second group, and the Q pulses of the third group is equal to N (i.e. S+P+Q=N). However, since each of the Q pulses of the third group has an inactive state, strobe signal 50 still provides up to the product of (S+1)*(P+1) gradation levels for each thermal element 42.

Figure 4:
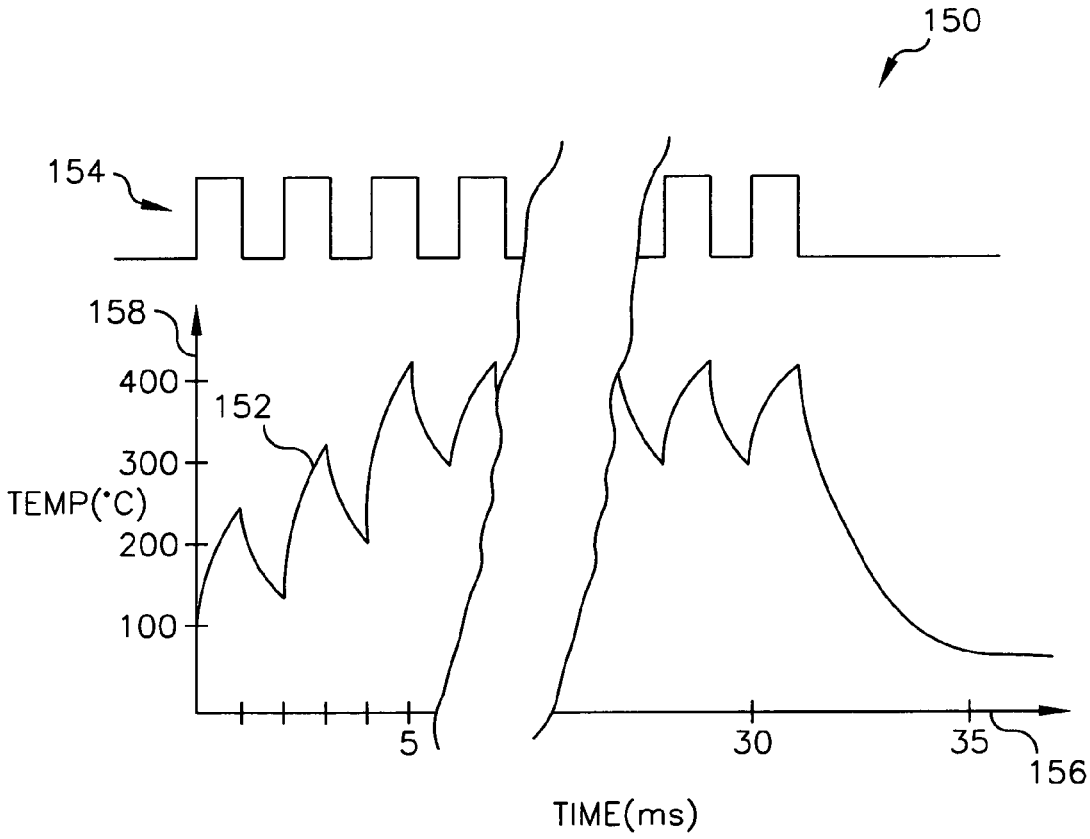
FIG. 4 is a graph illustrating generally a characteristic heating curve of a thermal element.

FIG. 4 is a graph 150 of a waveform 152 illustrating generally the heating and cooling characteristics of a thermal element, such as thermal element 42*a* of FIG. 2, in response to a series of energization pulses, as illustrated by an example pulse waveform 154. Time, in milliseconds (ms), and temperature, in degrees centigrade (° C.), are illustrated respectively along x- and y-axes 156 and 158. As illustrated, because the thermal element cools more slowly than it heats, each successive energization pulse heats the thermal element to a successively higher peak temperature until a saturation temperature is reached. The temperature rise of the thermal element in response to each energization pulse depends on the width or duration of the energization pulse. If the width of the energization pulse is too narrow (i.e. the duration is too short), the energization pulse may not energize the thermal element for a long enough time period to have a meaningful effect on its temperature and thus, on the amount of thermal energy provided to the thermosensitive media.

With reference to FIG. 3, by configuring the active states of the data bits of the N-bit binary sequence such that whenever a data bit corresponding to one of the P strobe pulses of the second group has an active state the subsequent one of the S strobe pulses of the first group also has an active state, the energization pulse corresponding to the P strobe pulse is combined with the energization pulse corresponding to the subsequent S strobe pulse to form a continuous energization pulse. For example, energization pulse 118 corresponding to the strobe pulse "1" and energization pulse 120 corresponding to strobe pulse "2" combine to form a continuous energization pulse. In this fashion, energization pulse 118 more effectively contributes to energization and heating of thermal element 42*a* than if energization pulse 118 was a "stand-alone" energization pulse.

Figure 5:
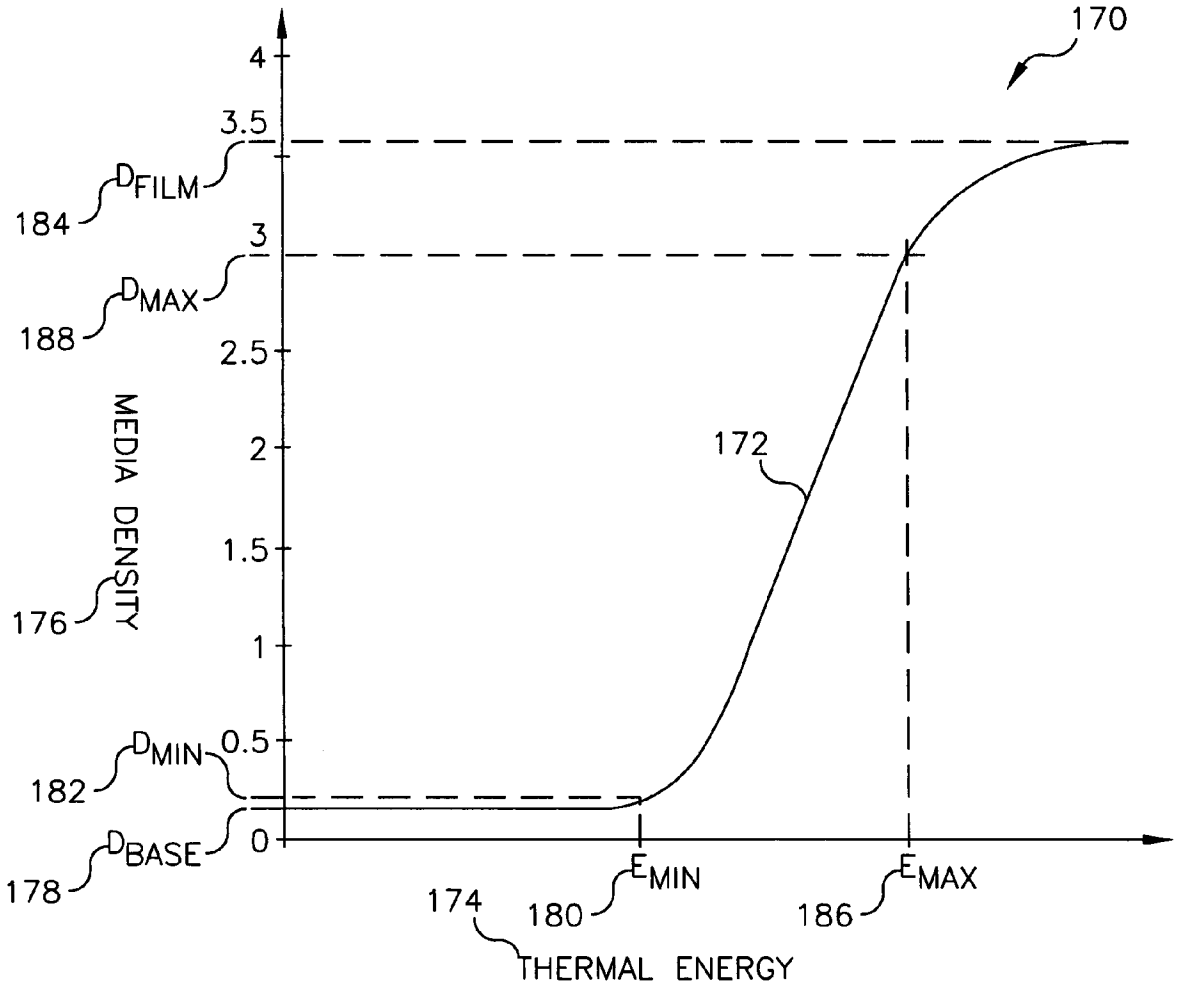
FIG. 5 is a graph illustrating an example of the density of a thermosensitive media versus applied thermal energy.

FIG. 5 is graph 170 of an example waveform 172 illustrating generally the printing density of thermosensitive media, such as thermosensitive media 46 (see FIG. 1), versus the amount of thermal energy applied by a thermal element, such as thermal element 42*a* (see FIG. 2). Thermal energy transferred to thermosensitive media 46 is illustrated along the x-axis, as indicated at 174, and the resulting print or media density is illustrated along the y-axis, as indicated at 176.

Thermosensitive media, such as thermosensitive media 46, has an inherent or "base" density prior to printing of an image by thermal printer 30. This base density is indicated as $D_{BASE}$ at 178. As described earlier, application of thermal energy to thermosensitive media 46 by thermal elements 42 produces a density that is proportional to the amount of thermal energy transferred to thermosensitive media 46. A certain minimum amount of thermal energy, indicated as $E_{MIN}$ at 180, is required to produce a minimum detectable change in density over the base density. This minimum detectable density is generally referred to as $D_{MIN}$, as indicated at 182. Amounts of thermal energy less than $E_{MIN}$ will produce a density change less than $D_{MIN}$ and thus, will generally not be detectable.

Similarly, a certain amount of thermal energy will produce a maximum density in thermosensitive media 46. This maximum density is generally referred to as $D_{FILM}$, as indicated at 184. Thermal energy in excess of this maximum amount can damage the thermosensitive media. As such, to avoid damaging the thermosensitive media when printing an image, the amount of thermal energy provided by the thermal elements is generally limited to a maximum "printing" thermal energy, indicated as $E_{MAX}$ at 186, that produces a maximum printing density, indicated as $D_{MAX}$ at 188, in the thermosensitive media.

In light of the above, even though thermal printer 30 according to the present invention is able to provide up to G gradation levels, where G is equal to the product of (S+1) multiplied by (P+1), a certain number of the gradation levels may not be useful or available for printing. In one embodiment, approximately 40 percent of the available gradation levels, G, correspond to levels below $D_{MIN}$ 182. In one embodiment, approximately 10 percent of the available gradation levels, G, correspond to levels above $D_{MAX}$ 188. In one embodiment, only those gradation levels corresponding to media densities between $D_{MIN}$ 182 and $D_{MAX}$ 188 are employed for printing. In one embodiment, approximately 50 percent of the available gradation levels, G, correspond to print densities at or between $D_{MIN}$ 182 and $D_{MAX}$ 188.

For example, continuing with the example illustration above where thermal printer 30 provides up to 4,096 possible gradation levels (i.e. P=7, S=511, and N=518), approximately 2,048 gradation levels are available for printing. In this example, thermal printer 30 according to the present invention provides 2,048 using a binary sequence of only 518 1-bit data values (i.e. N=518) as compared to some types of conventional printers which would require a binary sequence of 2,048 1-bit data values to provide 2,048 gradation levels.

If more gradation levels are desired, strobe signal 50 can be modified so as to provide a different strobe pulse configuration. For example, in one embodiment, as described above, strobe signal 50 comprises 526 pulses (i.e. N=526) with 15 pulses in the second group of strobe pulses (i.e. P=15) and 511 pulses in the first group of strobe pulses (i.e. S=511). According to this scenario, thermal printer 30 is able to provide up to 8,192 possible gradation levels with up to 4,096 gradation levels available for printing.

Figure 6:
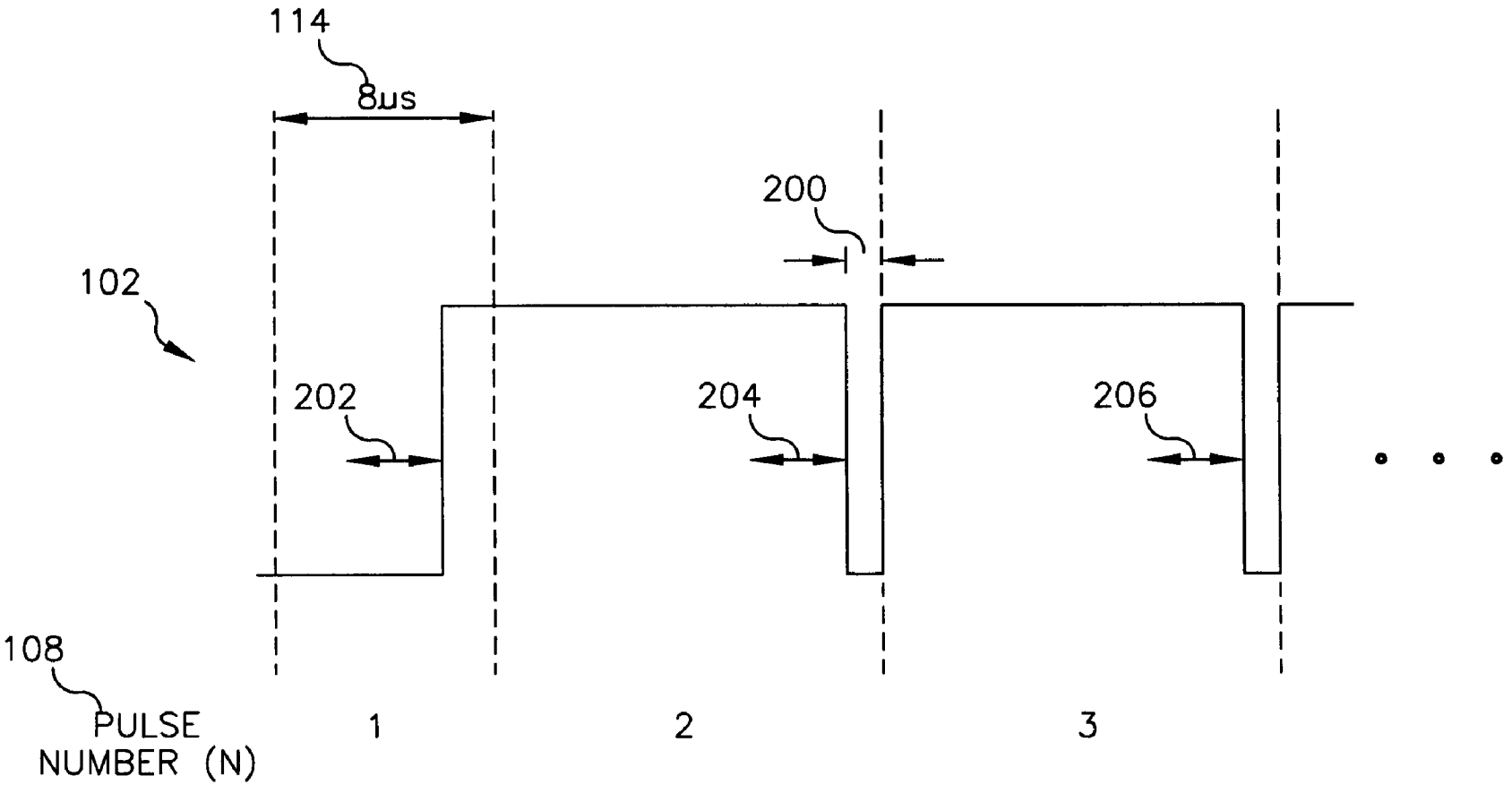
FIG. 6 is a diagram illustrating a portion of an example strobe signal according to the present invention.

FIG. 6 is an enlarged view of a portion of strobe signal 50 illustrated by waveform 102 of FIG. 3. In one embodiment, the duration of the active state of each of the S strobe pulses of the first group of strobe pulses is an incremental amount less than the strobe period, as indicated at 200. In one embodiment, data sequencer 40 (see FIGS. 1 and 2) is configured to increase and/or decrease the duration of the active states of each of the N strobe pulses based on various parameters such as a temperature of thermal printhead 34, a temperature of a heat sink (not illustrated) associated with thermal printhead 34, or an ambient temperature, for example. It is noted that each of the above temperatures is representative of a temperature of thermal elements 42.

According to one embodiment, data sequencer 40 is configured to increase or decrease that duration of the active state of each of the P pulses of the second group of strobe pulses by adjusting a position of a leading edge of the pulse, as indicated by directional 202. Similarly, data sequencer 40 is configured to increase or decrease the duration of the active state of each of the N pulses of the first group of strobe pulses by adjusting a position of a trailing edge of the pulses, as indicated by directional arrows 204 and 206. By adjusting each of the P pulses along their leading edges and each of the S pulses along their trailing edges, the active states of each of the P pulses and the immediately subsequent S pulse continue to form a continuous strobe pulse.

The invention has been described in detail with particular reference to certain preferred embodiments thereof, but it will be understood that variations and modifications can be effected within the spirit and scope of the invention.

What is claimed is:

1. A recording apparatus comprising:

a plurality of thermal elements;

a strobe generator configured to provide a strobe signal comprising a sequence of N pulses, the sequence including a first group of pulses having an active state for a first duration and a second group of pulses having an active state for a second duration, wherein each pulse of the second group is positioned next to a pulse of the first group such that their active states combine to form a substantially continuous active state; and a data sequencer configured to provide an N-bit sequence representative of a gradation level for each thermal element, each bit corresponding to one of the N pulses, wherein the N bits have active states such that whenever the corresponding gradation level is within a predetermined range and whenever a bit corresponding to a pulse of the second group has an active state the bit corresponding to the adjacent pulse of the first group has an active state, wherein each thermal element is configured to generate heat based on the strobe signal and the corresponding N-bit sequence.

2. The recording apparatus of claim 1, wherein the pulses of the second group are positioned at substantially equal intervals throughout the sequence of N pulses.

3. The recording apparatus of claim 1, wherein each of the N pulses has a same period, and wherein the first duration is substantially equal to a period.

4. The recording apparatus of claim 1, wherein the second duration is a fraction of the first duration.

5. The recording apparatus of claim 1, wherein a sum of the second durations of all pulses of the second group is substantially equal to a first duration of one pulse of the first group minus a second duration of one pulse of the second group.

6. The recording apparatus of claim 1, wherein the first group of pulses comprises a total of S pulses and the second group of pulses comprises a total of P pulses, where the sum of S and P is equal to N, and wherein the recording apparatus provides up to G gradation levels where G is equal to the product of (S+1) multiplied by (P+1).

7. The recording apparatus of claim 6, wherein S is equal to 511 and P is equal to 15 such that the N-bit sequence comprises 526 bits and the recording apparatus provides up to 8,192 gradation levels.

8. The recording apparatus of claim 7, wherein a ratio of the second duration to the first duration is substantially equal to 1/16.

9. The recording apparatus of claim 6, wherein S is equal to 511 and P is equal to 7 such that the N-bit sequence comprises 518 bits and the recording apparatus provides up to 8,192 gradation levels.

10. The recording apparatus of claim 9, wherein a ratio of the second duration to the first duration is substantially equal to 1/8.

11. The recording apparatus of claim 1, wherein the strobe generator is configured to adjust the first and second durations based on a plurality of operating parameters associated with the recording apparatus.

12. The recording apparatus of claim 11, wherein one of the plurality of operating parameters comprises a temperature which is representative of a temperature of the thermal elements.

13. The recording apparatus of claim 1, wherein the predetermined range is from a minimum gradation level to a maximum gradation level.

14. The recording apparatus of claim 13, wherein the minimum gradation level comprises a minimum printing density associated with a thermosensitive media intended for use with the recording apparatus.

15. The recording apparatus of claim 13, wherein the maximum gradation level comprises a maximum desired printing density associated with a thermosensitive media for intended use with the recording apparatus.

16. The recording apparatus of claim 1, wherein the strobe generator is configured to provide a strobe signal comprising a third group of pulses each having an inactive state.

17. The recording apparatus of claim 1, wherein the recording apparatus comprises a direct thermal printer.

18. A method of operating a thermal processor including a plurality of thermal elements, the method comprising:

providing a strobe signal comprising a sequence of N pulses, the sequence including a first group of pulses having an active state for a first duration and a second group of pulses having an active state for a second duration, wherein each pulse of the second group is positioned next to a pulse of the first group such that their active states combine to form a substantially continuous active state; and providing an N-bit data sequence representative of a gradation level for each thermal element, each bit corresponding to one of the N pulses, wherein the N bits have active states such that whenever the corresponding gradation level is within a predetermined range and whenever a bit corresponding to a pulse of the second group has an active state the bit corresponding to the adjacent pulse of the first group has an active state, wherein each thermal element is configured to generate heat based on the strobe signal and the corresponding N-bit sequence.

19. The method of claim 18, wherein providing the strobe signal includes positioning the second group of pulses at substantially equal intervals through the sequence of N pulses.

20. The method of claim 19, wherein each of the N strobe pulses has a same period, and wherein providing the strobe signal includes providing a first duration which is substantially equal to a period.

21. The method of claim 19, wherein providing the strobe signal includes providing a second duration which is a fraction of the first duration.

22. The method of claim 18, wherein providing the strobe signal includes providing a second group of pulses such that a sum of the second duration of all pulses of the second group is substantially equal to a first duration of one pulse of the first group minus a second duration of one pulse of the second group.

23. The method of claim 18, wherein providing the strobe signal includes adjusting the first and second durations based on a plurality of operating parameters associated with the thermal processor.

24. A direct thermal processor, comprising:

a plurality of thermal recording elements;

means for providing a strobe signal comprising a sequence of N pulses, the sequence including a first group of pulses having an active state for a first duration and a second group of pulses having an active state for a second duration, wherein each pulse of the second group is positioned next to a pulse of the first group such that their active states combine to form a substantially continuous active state; and means for providing an N-bit data sequence representative of a gradation level for each thermal element, each bit corresponding to one of the N pulses, wherein the N bits have active states such that whenever the corresponding gradation level is within a predetermined range and whenever a bit corresponding to a pulse of the second group has an active state the bit corresponding to the adjacent pulse of the first group has an active state, wherein each thermal element is configured to generate heat based on the strobe signal and the corresponding N-bit sequence.

* * * * *